US008798308B2

(12) United States Patent
Litovsky et al.

(10) Patent No.: US 8,798,308 B2
(45) Date of Patent: Aug. 5, 2014

(54) CONVECTIVE AIRFLOW USING A PASSIVE RADIATOR

(75) Inventors: Roman N. Litovsky, Newton, MA (US); Chester Smith Williams, Lexington, MA (US)

(73) Assignee: Bose Corporation, Framingham, MA (US)

( * ) Notice: Subject to any disclaimer, the term of this patent is extended or adjusted under 35 U.S.C. 154(b) by 132 days.

(21) Appl. No.: 13/400,718

(22) Filed: Feb. 21, 2012

(65) Prior Publication Data

US 2013/0213628 A1 Aug. 22, 2013

(51) Int. Cl.
*H04R 25/00* (2006.01)

(52) U.S. Cl.
USPC ..... 381/397; 381/164; 381/345

(58) Field of Classification Search
USPC ..... 381/335, 337, 338, 345, 348, 349, 351, 381/160, 162, 164, 165, 182, 186, 386, 381/397; 181/148, 155, 156, 199
See application file for complete search history.

(56) References Cited

U.S. PATENT DOCUMENTS

| | | | | |
|---|---|---|---|---|
| 3,778,551 | A * | 12/1973 | Grodinsky | 381/335 |
| 4,210,778 | A | 7/1980 | Sakurai et al. | |
| 4,379,951 | A | 4/1983 | Gabr | |
| 4,942,939 | A * | 7/1990 | Harrison | 181/156 |
| 5,097,513 | A * | 3/1992 | Jordan et al. | 381/160 |
| 5,533,132 | A | 7/1996 | Button | |
| 5,792,999 | A | 8/1998 | Arnold et al. | |
| 6,259,798 | B1 | 7/2001 | Perkins et al. | |
| 6,430,297 | B1 * | 8/2002 | Nakamura | 381/345 |
| 6,430,300 | B1 | 8/2002 | Cox et al. | |
| 6,504,938 | B1 | 1/2003 | Anderson et al. | |
| 7,133,533 | B2 | 11/2006 | Chick et al. | |
| 7,202,577 | B2 | 4/2007 | Parison et al. | |
| 7,463,744 | B2 | 12/2008 | Parker et al. | |
| 8,107,662 | B2 | 1/2012 | Parker | |
| 2004/0017924 | A1 | 1/2004 | Kuratani et al. | |
| 2004/0195039 | A1 | 10/2004 | Sahyoun | |
| 2005/0094837 | A1 | 5/2005 | Parker et al. | |
| 2005/0111673 | A1 | 5/2005 | Rosen et al. | |
| 2005/0169494 | A1 | 8/2005 | Stiles et al. | |
| 2006/0039571 | A1 | 2/2006 | Harris et al. | |

(Continued)

FOREIGN PATENT DOCUMENTS

| | | | |
|---|---|---|---|
| EP | 0991295 | A2 | 4/2000 |
| JP | 63074297 | A | 4/1988 |

(Continued)

OTHER PUBLICATIONS

International Search Report and Written Opinion dated Apr. 22, 2013 for PCT/US2013/026681.

*Primary Examiner* — Huyen D Le

(57) ABSTRACT

Systems and methods to remove heat from an acoustic enclosure are provided. An apparatus for reproducing acoustic signals includes an acoustic enclosure comprising an acoustic volume. A heat producing element is coupled to the acoustic enclosure, and a thermally conductive structure is thermally coupled to the heat producing element. The thermally conductive structure includes a first surface. A first passive radiator includes a first diaphragm. The first diaphragm extends over at least a portion of the first surface and moves in response to pressure variations within the acoustic volume. Movement of the first diaphragm causes air to flow over the first surface, to facilitate heat removal from the thermally conductive structure.

18 Claims, 3 Drawing Sheets

(56) References Cited

U.S. PATENT DOCUMENTS

| | | | |
|---|---|---|---|
| 2007/0092096 | A1 | 4/2007 | Litovsky |
| 2007/0258612 | A1 | 11/2007 | Mamin |
| 2009/0245561 | A1 | 10/2009 | Litovsky et al. |
| 2010/0027815 | A1 | 2/2010 | Burge |
| 2012/0051573 | A1 | 3/2012 | Litovsky et al. |

FOREIGN PATENT DOCUMENTS

| | | | |
|---|---|---|---|
| JP | 2004274383 | A | 9/2004 |
| JP | 2005295334 | A | 10/2005 |
| JP | 2005295335 | A | 10/2005 |
| WO | 2008/064294 | A2 | 5/2008 |

* cited by examiner

CONVECTIVE AIRFLOW USING A PASSIVE RADIATOR

I. FIELD OF THE DISCLOSURE

The disclosure relates to heat removal in acoustic devices, and more particularly, to heat removal from acoustic enclosures.

II. BACKGROUND

To satisfy user demands for convenience and practicality, speaker systems are designed to be light and small. Smaller spacing requirements in a speaker system can present heat dissipation challenges. For example, an energized voice coil of an acoustic transducer generates heat that can reduce speaker performance and durability. While forced air convection devices are helpful in dissipating heat, fan components in such devices can consume power, space, and introduce additional heat.

III. SUMMARY OF THE DISCLOSURE

In a particular embodiment, an apparatus for reproducing acoustic signals includes an acoustic enclosure comprising an acoustic volume. A heat producing element is coupled to the acoustic enclosure, and a structure is thermally coupled to the heat producing element. The structure includes a first surface. A first passive radiator includes a first diaphragm. The first diaphragm extends over at least a portion of the first surface and moves in response to pressure variations within the acoustic volume. Movement of the first diaphragm causes air to flow over the first surface.

In another embodiment, an apparatus for reproducing acoustic signals includes an acoustic enclosure and a first passive radiator coupled to the acoustic enclosure. The first passive radiator includes a first diaphragm. A second passive radiator, which includes a second diaphragm, is coupled to the acoustic enclosure. A structure is at least partially positioned between the first passive radiator and the second passive radiator. Movement of at least one of the first diaphragm and the second diaphragm causes air external to the acoustic enclosure to flow over the structure.

In another embodiment, a method of cooling an acoustic enclosure includes positioning a heat producing element within the acoustic enclosure and thermally coupling the heat producing element to a structure that includes a first surface. A first passive radiator is positioned such that a diaphragm of the passive radiator extends at least partially over the surface. Movement of the first diaphragm causes air to flow over the surface.

According to another particular embodiment, movement of a passive radiator initiates airflow that removes heat from the structure and the enclosure. The passive radiator further draws in cooler, ambient air to absorb additional heat from the structure. A frame securing the passive radiator and the structure in a fixed relationship additionally strengthens the structural integrity of the enclosure. An increase in the amount of heat removed by the passive radiator coincides with an increase in heat production by an acoustic transducer. The acoustic transducer generates relatively more heat when radiating more frequent or larger sound waves that drive the action of the passive radiator.

These and other advantages and features that characterize embodiments are set forth in the claims annexed hereto and forming a further part hereof. However, for a better understanding of the invention, and of the advantages and objectives attained through its use, reference should be made to the drawings and to the accompanying descriptive matter in which there are described exemplary embodiments.

IV. BRIEF DESCRIPTION OF THE DRAWINGS

V. DETAILED DESCRIPTION

In a particular embodiment, an apparatus uses a passive radiator to create airflow that removes heat from an acoustic enclosure. A diaphragm of the passive radiator moves in response to air pressure changes within the acoustic enclosure. A thermally conductive structure extends over at least a portion of the passive radiator. The structure is coupled via a low thermal resistance thermally conductive path to one or more heat sources located within or coupled to the enclosure. Air accelerated by motion of the diaphragm flows over and conducts heat away from the structure and out of the acoustic enclosure. A frame secures the passive radiator and the structure in a fixed relationship, or the passive radiator is directly affixed to the structure.

Changes in air pressure within the enclosure are caused by motion of the diaphragm of an acoustic transducer coupled to the acoustic enclosure. The air pressure variations inside the acoustic enclosure, in turn, cause the passive radiator to vibrate. Thermally conductive fasteners couple to one another and to at least one of the structure, the passive radiator, and the frame. The airflow initiated by the passive radiator flows over a surface of the structure. The airflow over the surface thus absorbs and carries away heat from the surface of the structure.

Figure 1:
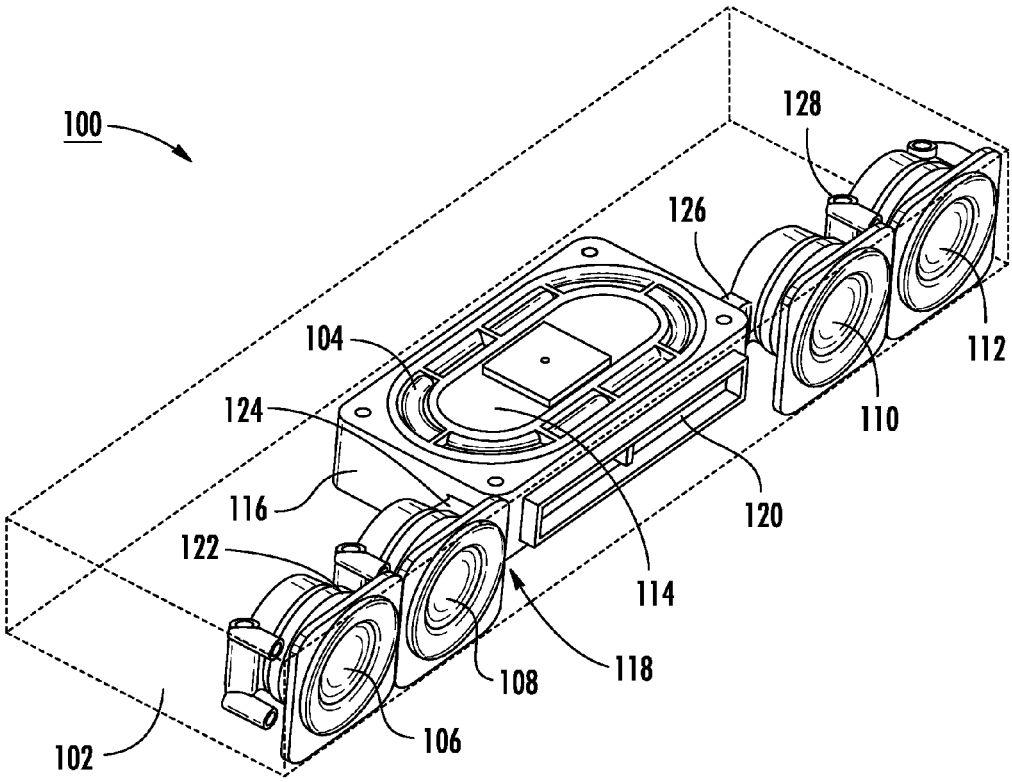
FIG. 1 is a perspective, partially transparent view of an embodiment of an apparatus having a passive radiator configured to remove heat from an acoustic enclosure.

Turning more particularly to the drawings, FIG. 1 is a perspective, partially transparent view of an apparatus 100 that includes an acoustic enclosure 102 (shown in outline) housing a first passive radiator 104. The first passive radiator 104 includes a first diaphragm 114 that moves in response to changes in air pressure within the acoustic enclosure 102. The air pressure changes are caused by activation of the acoustic transducers 106, 108, 110, 112. Though the embodiment of FIG. 1 shows four acoustic transducers, use of any number of acoustic transducers in an enclosure is contemplated herein. As described herein, airflow initiated by the movement of the first diaphragm 114 carries heat away from the acoustic enclosure 102.

A thermally conductive structure 116 includes a frame that secures the first passive radiator 104 in a fixed relationship to a second passive radiator 118 having a second diaphragm (not shown). Though not shown in the perspective view of FIG. 1, a fin (analogous to fin 230 shown in FIG. 2) which is part of the thermally conductive structure 116 is positioned between the first passive radiator 104 and the second passive radiator 118. The structure 116 is thermally coupled to one or more acoustic transducers 106, 108, 110, 112 or other heat producing elements, such as amplifiers or power sources. Though the frame is shown as part of the thermally conductive structure 116, this is not required. The frame that secures the passive radiators can be separate from the thermally conductive structure 116. In either case, as explained herein, the thermal coupling between heat sources and the thermally conductive structure enables heat generated by heat sources such as the acoustic transducers 106, 108, 110, 112 to flow to the structure. Movement of at least one of the first diaphragm 114 and the second diaphragm of the second passive radiator 118 causes air to flow over the structure 116, in particular causing air to flow over the fin. The air further flows in and out of an opening 120 in the enclosure 102.

The second passive radiator 118 is arranged relative to the first passive radiator 104 in such a manner as to provide additional heat removal. The first and the second passive radiators 104, 118 are positioned relatively close to one another and on different sides of the fin. A portion of the structure, which in some embodiments is the fin of the structure, extends over a portion of at least one of the first and second passive radiators 104, 118.

In the embodiment of FIG. 1, the first and second passive radiators 104, 118 move mechanically out-of-phase, but acoustically in-phase. Each of the first and second passive radiators 104, 118 includes a diaphragm (e.g., diaphragm 114) having opposing sides. A first side of the diaphragm 114 is exposed to the interior volume of the enclosure 102. The second, opposite side of the diaphragm 114 is exposed to the external environment (and structure) via the opening 120. An increase in pressure within the enclosure 102 substantially simultaneously causes the diaphragm 114 of the passive radiator 104 to move downward, and the diaphragm of the passive radiator 118 to move upward.

Air flows over multiple surfaces of the structure as the first and second passive radiators 104, 118 move in a coordinated fashion to expel or to intake air. When the first and second passive radiators 104, 118 move in opposite directions (e.g., respective directions away from the structure), cooler air is drawn inside a space between the first and second passive radiators 104, 118. The cooler air comes in thermal contact with the heated surfaces of the structure. The air absorbs heat prior to being expelled during a next, coordinated movement of the first and second passive radiators 104, 118 (e.g., respective directions toward the structure). The first and second passive radiators 104, 118, because of their arrangement in enclosure 102, move mechanically out-of-phase which cancels inertia, provides mechanical balance, and reduces vibration of the enclosure.

One or more of the acoustic transducers 106, 108, 110, 112 are coupled by thermally conductive fasteners 122, 124, 126, 128 to one another and to at least one of the structure, the frame 116, the first passive radiator 104, and the second passive radiator 118. Coupling thermal energy from the acoustic transducers 106, 108, 110, 112 to the structure facilitates the removal of heat. The heat is absorbed and carried by air that is forced out of the opening 120. Such airflow is created by movement of the first and second passive radiators 104, 118.

Additionally, coupling the acoustic transducers 106, 108, 110, 112 together evenly distributes heat among the acoustic transducers 106, 108, 110, 112 and increases thermal mass. The increased thermal mass provides protection against thermal overload.

An illustrative thermally conductive fastener includes a metal plate that is coupled to a backside of a transducer cup of an acoustic transducer. Another thermally conductive fastener includes a metal (e.g., aluminum, copper, or other thermally conductive metal) ring that slides around and contacts a transducer cup. Thermally conductive materials, such as gaskets, compounds, deformable metal pads, or thermal greases are used as thermal interface materials to reduce the thermal resistance of the interface between different components of the thermally conductive structure. Without loss of generality, thermal interface materials can be used anywhere in the thermal path where different structures are joined together, even if they are not specifically mentioned when a particular interface is described in this disclosure.

The acoustic transducers 106, 108, 110, 112 may be either front mounted or rear mounted. When rear-mounted, the acoustic transducers 106, 108, 110, 112 are attached to the structure and the entire assembly is then fitted to the enclosure 102. When the acoustic transducers 106, 108, 110, 112 are alternatively front-mounted, the individual acoustic transducers 106, 108, 110, 112 are mounted to the enclosure 102 first, and then the structure is fit to the mounted acoustic transducers 106, 108, 110, 112. In some embodiments, the frame 116 provides additional structural support and integrity to the enclosure 102.

The structure 116 includes thermally conductive contacts to transfer heat to an exterior surface of the enclosure 102. For example, the structure 116 includes a mounting clamp that holds an acoustic transducer near an external surface or opening of the enclosure 102. The structure 116 is constructed from thermally conductive material to efficiently transfer heat to the exterior of the enclosure 102.

As described below in greater detail, the structure includes a fin, which may be made from a thermally conductive metal or polymer material, or other thermally conductive material such as a carbon based material or other known thermally conductive materials, that is thermally coupled to a heat producing element and that extends over at least a portion of a diaphragm 118. The structure is typically manufactured to be thin for space considerations. In an embodiment, the structure additionally includes a mesh-like, thermally conductive material, such as wire. The wire mesh material provides a relatively large surface area for transferring heat with ambient air. An embodiment of the structure further includes perforated metal. In addition to facilitating heat exchange, apertures in the structure assist with maintaining mechanical balance during the motion of the first and second passive radiators 104, 114. The apertures are included in a section of the structure that is positioned between the passive radiators 104, 114 and that is external to the enclosure 102. Controlling the mechanical balance reduces undesirable vibrations of the enclosure 102. The structure of an embodiment further includes a contoured surface, such as a ribbed or grooved surface. Such ribs, grooves, or folds, increase the surface area of the structure. The increased surface improves heat transfer from the structure to the air.

The first and second passive radiators 104, 118 are constructed from plastic or a combination of plastic and metal. An embodiment of a passive radiator includes a diaphragm. In some embodiments, the diaphragm is formed from a polymer material. In some embodiments, the polymer diaphragm is doped with metal flakes to increase its mass. In some embodiments, the metal flakes are thermally conductive to allow the diaphragm to provide some additional heat dissipation. In some embodiments, the diaphragm is made of a thermally conductive material such as aluminum, copper, other thermally conductive metals, or other thermally conductive materials. Hot air within the enclosure transfers heat to the diaphragm surface that is in contact with the heated air, and the diaphragm in turn can radiate that heat out to the external environment. Increasing the thermal conductivity of the diaphragm increases the amount of heat it is possible to transfer through the diaphragm. The heat dissipating capability of the passive radiator diaphragm can be increased by increasing the surface area of the diaphragm, on one or both sides of the diaphragm. For example, ribs, pins, or other protruding structures can be formed on one or both surfaces of the diaphragm. The surfaces can be treated to increase the surface area using known methods, such as chemical etching, sand blasting, etc.

More particularly, the passive radiators 104, 118 include a suspension element, or a surround, and a diaphragm. The surround functions as a spring. The diaphragm is rigid over at least the operating frequency range of the passive radiator and functions as a mass. The moving mass of the passive radiator 104, 118 can resonate with the stiffness of the suspension surround. This resonance is set to be lower than the resonance of the passive radiator moving mass with the stiffness of the air in the enclosure. As such, the self resonance of the passive radiator is lower in frequency than the resonance of the moving mass with the air stiffness of the enclosure.

The amplitude of motion of the passive radiators 104, 118 is correlated with the level of low frequency signal applied to the transducers 106, 108, 110, 112. As the acoustic system is called on to produce increased low frequency output, the amplitude of motion of the passive radiators increases. The increased amplitude of motion increases the amount of air pumped over the structure and increases cooling. In this manner, the apparatus 100 self-adjusts by increasing cooling during a period when heat production increases due to increased acoustic transducer activity.

FIG. 1 thus shows a system 100 having a structure 116 with a surface, such as a fin, that is thermally coupled to heat sources (e.g., transducers 106, 108, 110, 112) and that extends over at least a portion of passive radiators 104, 118. The passive radiators 104, 118 pump air over the surface to cool the structure. While FIG. 1 shows a structure with the passive radiators 104, 118 positioned inboard from the exterior envelope of the enclosure 102, another embodiment includes a single passive radiator, such as just passive radiator 114. In some embodiments, a passive radiator or passive radiators can be positioned on an exterior surface of an enclosure. For example, a single passive radiator is positioned on an one side of the enclosure. In another example, a first passive radiator is positioned on one, opposite side of an enclosure relative to another passive radiator, and a structure or structures coupled to heat sources extends over at least a portion of the one passive radiator, or over at least one of or both of the opposite wall mounted passive radiator diaphragms. In another embodiment, a structure extends over the entire diaphragm surface of the one passive radiator, or over the entire surface of both of the opposite wall mounted passive radiators. In the example of opposite wall mounted passive radiators, such an arrangement provides mechanical out-of-phase motion and acoustically in-phase motion. Alternatively, the passive radiators can be mounted on the same side of an enclosure, and a single structure coupled to heat sources extends over at least a portion of one passive radiator, or over a portion of both passive radiators. In another embodiment, the structure extends over the entire surface of each passive radiator diaphragm. As such, the passive radiator motions are mechanically and acoustically in-phase.

Figure 2:
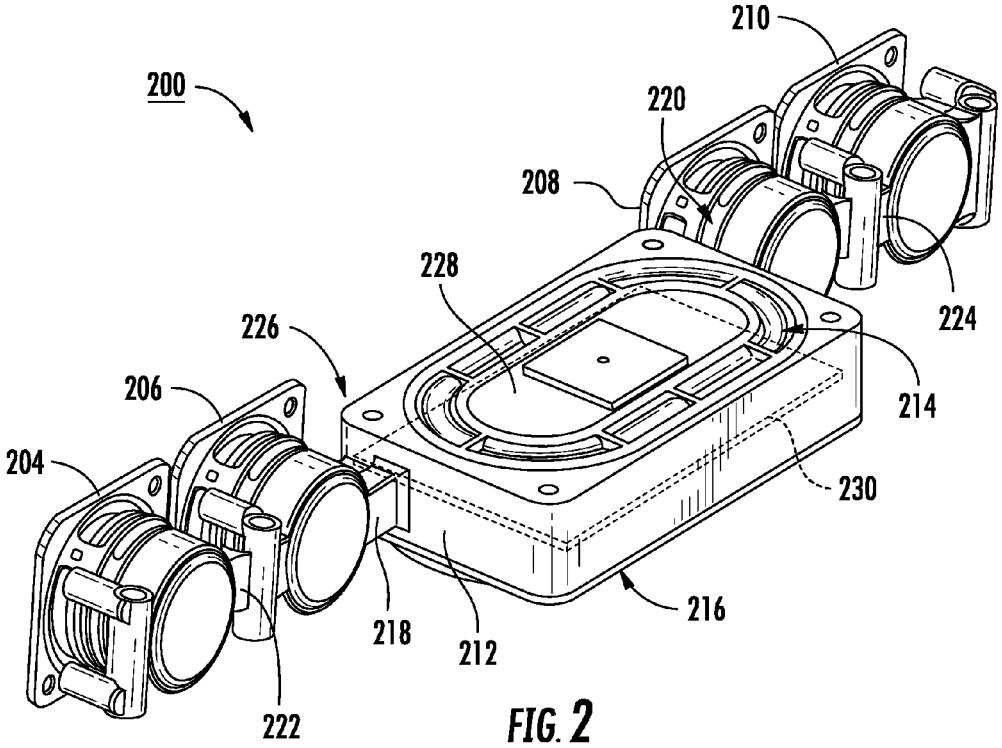
FIG. 2 is an exploded view of an apparatus that includes multiple acoustic transducers that are thermally coupled to a frame that secures a passive radiator to a structure.

FIG. 2 is an exploded view of an apparatus 200 that includes multiple acoustic transducers 204, 206, 208, 210 thermally coupled to a frame 212 that secures a first passive radiator 214 to an internal structure 230, such as a metal plate or fin. The plate or fin 230 of an embodiment is formed integrally with the housing connecting together all of the transducers 204, 206, 208, 210 (e.g., in a single aluminum casting, though other thermally conductive materials can also be used), forming a thermally conductive structure that thermally couples the heat sources (in this case the acoustic transducers) with the fin 230. The acoustic transducers 204, 206, 208, 210 are similar to the acoustic transducers 106, 108, 110, 112 of FIG. 1, and the first passive radiator 214 is similar to the first passive radiator 104 of FIG. 1. As shown in FIG. 2, the frame 212 additionally secures the first passive radiator 214 (and the internal structure 230) to a second passive radiator 216 in a fixed relationship. For example, the first and second passive radiators 214, 216 and the fin 230 are arranged in parallel to one another, with the internal fin 230 secured substantially equidistant between the first and second passive radiators 214, 216.

The frame 212 includes an opening 226. Movement of a diaphragm 228 of the first passive radiator 214 and movement of a diaphragm (not shown) of the second passive radiator 216 initiates airflow through the opening 226. The frame 212 is constructed of thermally conductive material, such as a thermally conductive metal or polymer material, or other thermally conductive material such as a carbon based material or other known thermally conductive materials. The frame 212 of an embodiment is formed integrally with connecting structures that allow connection to at least one of a transducer 204, 206, 208, 210 and the structure 230 (e.g., a single, aluminum casting). The frame 212 of another embodiment is formed from multiple, assembled sections.

According to a particular embodiment, a first thermally conductive connecting section 218 physically and thermally couples the first acoustic transducer 206 to at least one of the frame 212, the first passive radiator 214, the second passive radiator 216, and the structure 230 positioned within the frame 212. The passive radiators 214, 216 introduce forced convection cooling. The forced convection cooling improves the heat transfer from the fin 230 to the ambient environment. Heat is dissipated from the heated surface of the fin 230 to the air. More particularly, air molecules interact with the hot surface of the structure 230 and absorb heat energy from it. The forced convention cooling is caused by movement of the passive radiators 214, 216, which move in response to air pressure changes within the acoustic enclosure. Changes in air pressure within the enclosure are caused by motion of the diaphragm(s) of an acoustic transducer 204, 206, 208, 210 coupled to the acoustic enclosure.

A second thermally conductive connecting section 220 physically and thermally couples the second acoustic transducer 208 to at least one of the frame 212, the first passive radiator 214, the second passive radiator 216, and the fin 230. A third thermally conductive connecting section 222 physically and thermally couples the third transducer 204 to the first conductive connecting section 218 and to the first acoustic transducer 204. As such, the third acoustic transducer 204 is thermally coupled to at least one of the frame 212, the first passive radiator 214, the second passive radiator 216, and the fin 230. A fourth thermally conductive connecting section 224 physically and thermally couples the fourth acoustic transducer 210 to the second thermally conductive fastener 220. In this manner, the fourth acoustic transducer 210 is thermally coupled to at least one of the frame 212, the first passive radiator 214, the second passive radiator 216, and the fin 230. The thermally conductive fasteners 218, 220, 222, 224 are similar to the thermally conductive fasteners 122, 124, 126, 128 of FIG. 1. In some embodiments, the cross sectional area of connecting sections 218 and 220, taken in an orientation normal to the direction of heat flow from the transducers to the frame 212, is larger than the cross sectional area of sections 222 and 224. The sections 218 and 220 must allow heat flow from a pair of heat sources to the frame, whereas the sections 222 and 224 may only accommodate the heat flow from a single source. In some embodiments, the cross sectional area of connecting sections 222 and 224 is one half of the cross sectional area of sections 218 and 220.

Thermal mass of the apparatus 200 is increased by thermally coupling together the acoustic transducers 204, 206, 208, 210. Moreover, the thermally conductive connecting sections 218, 220, 222, 224 reduce occurrences of a transducer becoming disproportionately hot by evenly, or substantially evenly, distributing heat among the acoustic transducers 204, 206, 208, 210. As shown in FIG. 2, the thermally conductive connecting sections 218, 220, 222, 224 include metal rings that slide around and contact transducer cups of the acoustic transducers 204, 206, 208, 210. In a particular embodiment, a thermally conductive connecting section includes a metal plate that thermally couples to a backside of a transducer cup of an acoustic transducer. Heat sink and other thermally conductive interface materials are used to reduce the thermal resistance of the interface between the acoustic transducers 204, 206, 208, 210, the thermally conductive connecting sections 218, 220, 222, 224, and at least one of the frame 212, the first passive radiator 214, the second passive radiator 216, and the fin 230.

Figure 3:
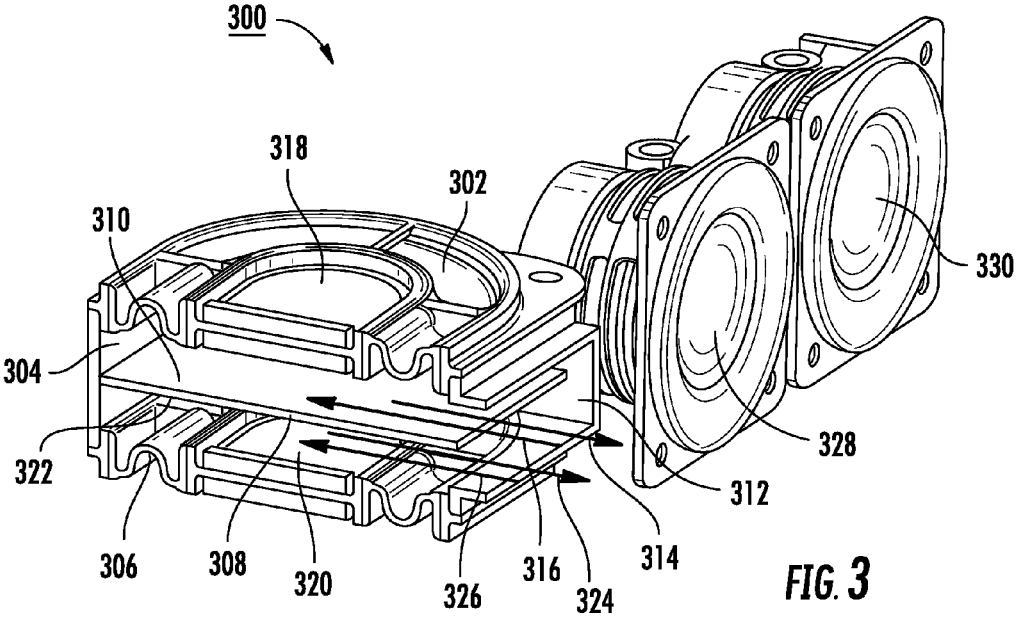
FIG. 3 is a cross-sectional, perspective view of an apparatus that includes a first passive radiator that is secured via a frame to a second passive radiator.

FIG. 3 is a cut-away perspective view of an apparatus 300 that includes a first passive radiator 302 that is secured via a frame 304 to a second passive radiator 306. A structure 308 such as a metal plate or fin is secured between the first passive and second passive radiators 302, 306. The frame 304 and fin 308 form a thermally conductive structure for coupling to heat sources, such as acoustic transducers 328, 330. As shown in FIG. 3, at least a portion of each of the first and second passive radiators 302, 306 partially extends over the fin 308. For example, at least a portion of the first passive radiator 302 extends vertically above and substantially parallel to the fin 308, and at least a portion of the second passive radiator 306 extends vertically below and substantially parallel to the fin 308.

A first movement of a first diaphragm 318 of the first passive radiator 302 (e.g., in a direction towards the structure 308) promotes the flow of air over a first surface 310 of the fin 308. The air absorbs thermal energy from the first surface 310 and travels out of an opening 312 of the frame 304, as shown by the arrow 314. Subsequent motion of the first diaphragm 308 (e.g., in a direction away from the structure 308) draws cooler, ambient air in through the opening 312 and over the first surface 310, as shown by the arrow 316. The ambient air absorbs heat transferred from the first surface 310. The air is expelled out of the opening 312 by a subsequent movement of the first diaphragm 318.

A first movement of a second diaphragm 320 of the second passive radiator 306 promotes the flow of air over a second surface 322 of the fin 308 and out the opening 312 of the frame 304, as shown by the arrow 324. A subsequent movement of the second diaphragm 320 (e.g., in a direction away from the structure 308) draws cooler air in through the opening 312 and over the second surface 322, as shown by the arrow 326.

In some embodiments, the fin 308 of FIG. 3 includes a thin metal layer. The fin 308 of another embodiment includes a mesh, or wire-like thermally conductive material. Apertures in the fin 308 facilitate heat exchange and assist with mechanical balance (e.g., reducing vibrations) caused by the motion of the first and second diaphragms 318, 320. In some embodiments, the fin 308 further includes a fold, a rib, or a groove. The vertical distance between the first passive radiator 302 and the fin 308 is set based on airflow and heat absorption dynamics, as well as space demands and acoustical considerations (e.g., so as to minimally affect acoustics). The fin 308 is placed sufficiently far from the passive radiator mounting surfaces such that the passive radiators 302, 306 under their maximum operating excursion cannot physically contact the fin 308.

Acoustic transducers 328, 330 are thermally coupled to at least one of the frame 304, the first passive radiator 302, the second passive radiator 306, and the fin 308. The acoustic transducers 328, 330 are similar to the acoustic transducers 110, 112 of FIG. 1. The first passive radiator 302 and the second passive radiator 306 are similar to the first passive radiator 104 and the second passive radiator 118 of FIG. 1. The opening 312 is similar to the opening 120 of FIG. 1. The frame 304 of FIG. 3 includes only one opening 312. However, a frame of another embodiment is open on multiple sides. For example, a frame of another embodiment includes a second opening that is located on a side opposite the opening 312.

Figure 4:
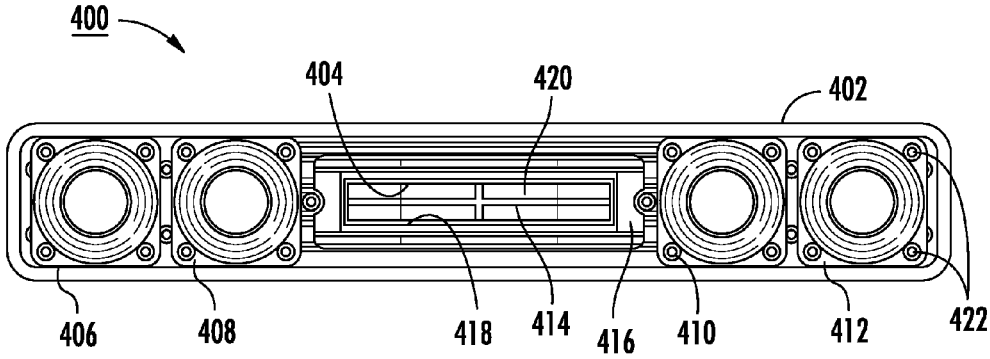
FIG. 4 is a front view of an apparatus that includes an acoustic enclosure housing dual passive radiators and a structure that is thermally coupled to multiple transducers.

FIG. 4 is a front view of an apparatus 400 that includes an acoustic enclosure 402 housing a first passive radiator 404 and multiple acoustic transducers 406, 408, 410, 412. A frame 416 secures the first passive radiator 404 in a fixed relationship to a second passive radiator 418. A structure 414 is positioned between the first passive radiator 404 and the second passive radiator 418.

As is visible in FIG. 4 through an opening 420 in the frame 416, at least a portion of the structure 414 extends, or overlaps, at least a portion of at least one of the first and second passive radiators 404, 418. For instance, a portion of the structure 414 extends vertically beneath and parallel to first passive radiator 404, and a portion of the structure 414 extends vertically above and parallel to the second passive radiator 418.

One or more of the acoustic transducers 406, 408, 410, 412 are thermally coupled to one another and to at least one of the structure 414, the frame 416, the first passive radiator 404, and the second passive radiator 418. The acoustic transducers 406, 408, 410, 412 are front-mounted into the acoustic enclosure 402 during manufacture. Fasteners 422 secure the acoustic transducers 406, 408, 410, 412 to the exterior of the enclosure 102 for additional heat removal considerations.

Movement of at least one of the first and second passive radiators 404, 418 causes air to flow in and out of the opening 420 of the acoustic enclosure 402. The acoustic enclosure 402 is similar to the acoustic enclosure 102 of FIG. 1, and the opening 420 is similar to the opening 120 of FIG. 1. Additionally, the acoustic transducers 406, 408, 410, 412 are similar to the acoustic transducers 106, 108, 110, 112 of FIG. 1.

The first and second passive radiators 404, 418 are used to create airflow that removes heat from the acoustic enclosure 402. Respective diaphragms of the first and second passive radiators 404, 418 move in response to air pressure changes within the acoustic enclosure 402. Heat is thermally coupled to the structure 414. Air accelerated by the motion of the first and second passive radiators 404, 418 flows over and conducts heat away from structure 414 and out of the opening 420 of the acoustic enclosure 402.

Movement of the first and second passive radiators 404, 418 ejects warm air from the opening 420 of the acoustic enclosure 402, and alternatively, intakes cooler, ambient air. A low thermal resistance path exists between the structure 414 and the heat sources, such as the acoustic transducers 406, 408, 410, 412. The passive radiators 404, 418 pump air over the surfaces of the structure 414. The airflow over the surfaces of the structure 414 absorbs and transfers the thermal energy out of the opening 420 of the enclosure 402.

Figure 5:
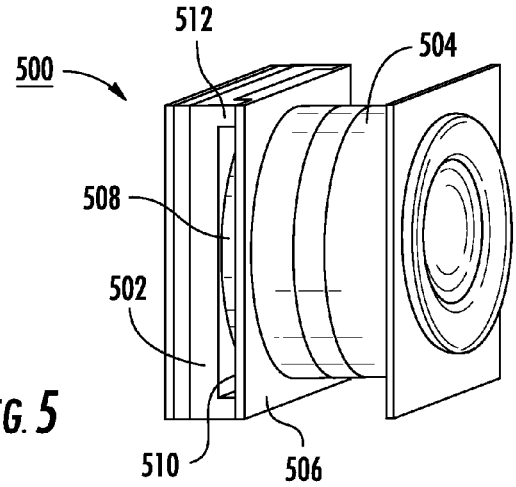
FIG. 5 is a perspective view of a single passive radiator that is secured in a fixed relationship to a convective structure comprising part of an acoustic transducer.

FIG. 5 illustrates a perspective view of an embodiment of an apparatus 500 having a single passive radiator 502 that is secured in a fixed relationship to an acoustic transducer 504. A structure 506, such as a metal plate, is positioned between the passive radiator 502 and the acoustic transducer 504. The structure 506 is thermally coupled to the acoustic transducer 504. Though not shown, heat sink material is positioned between the structure 506 and the acoustic transducer 504. According to a particular embodiment, the structure 506 comprises a component of the acoustic transducer 504, such as a surface of an acoustic cup. As such, the embodiment shown in FIG. 5 includes a single passive radiator 502 that is secured in a fixed relationship to a structure 506 comprising part of an acoustic transducer 504.

A diaphragm 508 of the passive radiator 502 moves in response to changes in air pressure caused by activation of the acoustic transducer 504. The movement of the diaphragm 508 initiates airflow over a surface 510 of the structure 506. The airflow absorbs and removes heat from the surface 510. A surface of the structure 506 includes contours, such as grooves or extensions, to increase surface area and thermal exchange with the airflow. A frame 512 secures the acoustic transducer 504 in a fixed relationship to the passive radiator 502.

Figure 6:
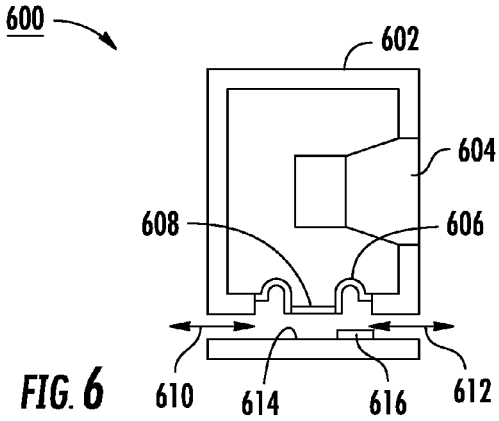
FIG. 6 is a cross-sectional perspective view of an apparatus that includes an enclosure, an acoustic transducer, and a passive radiator secured in a fixed relationship.

FIG. 6 illustrates a cross-sectional perspective view of a block diagram of an embodiment of an apparatus 600 that includes an enclosure 602, an acoustic transducer 604, and a passive radiator 606. A pressure variation within the enclosure 602 initiates movement of a diaphragm 608 of the passive radiator 606. The movement of the diaphragm 608 initiates airflow (indicated by the arrows) in and out of a first opening 610 and a second opening 612. The first and second openings 610, 612 are partially formed by a structure 614. The structure 614 receives thermal energy from a heat producing element 616, such as a power supply or an amplifier for a loudspeaker. The structure 614 is formed, at least in part, from a thermally conductive material, such as a thermally conductive metal or polymer material, or other thermally conductive material such as a carbon based material or other known thermally conductive materials.

The airflow absorbs and removes heat from at least one of the surface of structure 614 and the heat producing element 616. More specifically, a first movement of the diaphragm 608 (e.g., towards the surface 614) expels warmed air out of the first and second openings 610, 612. A second movement of the diaphragm 608 (e.g., away the surface 614) causes cooler, ambient air to travel in the enclosure 602 through the first and second openings 610, 612.

Those skilled in the art may make numerous uses and modifications of and departures from the specific apparatus and techniques disclosed herein without departing from the inventive concepts. Consequently, the disclosed embodiments should be construed as embracing each and every novel feature and novel combination of features present in or possessed by the apparatus and techniques disclosed herein and limited only by the scope of the appended claims, and equivalents thereof.

The invention claimed is:

1. An apparatus for reproducing acoustic signals, the apparatus comprising:

an acoustic enclosure comprising an acoustic volume;

a heat producing element comprising a first acoustic transducer coupled to the acoustic enclosure;

a thermally conductive structure thermally coupled to the first acoustic transducer via a low thermal resistance path, wherein the structure includes a first surface; and a first passive radiator including a first diaphragm, wherein the first diaphragm extends over at least a portion of the first surface and moves in response to pressure variations within the acoustic volume, and wherein movement of the first diaphragm causes air to flow over the first surface.

2. The apparatus of claim 1 wherein the structure comprises a fin, and the first surface is a surface of the fin.

3. The apparatus of claim 1, wherein the heat producing element is a first acoustic transducer component configured to radiate a sound wave.

4. The apparatus of claim 1, wherein the first acoustic transducer component is thermally coupled to a second acoustic transducer component.

5. The apparatus of claim 1, further comprising a thermally conductive connecting section coupling the heat producing element to the structure.

6. The apparatus of claim 1, wherein the heat producing element and the structure are formed integrally.

7. The apparatus of claim 1, wherein the portion of the first surface of the structure includes at least one of wire meshed material, a fin, a perforated metal, and a metal plate.

8. The apparatus of claim 1, wherein the portion of the first surface of the structure includes at least one of an aperture, a groove, a fold, and an extension.

9. The apparatus of claim 1, wherein the heat producing element is located within the acoustic enclosure.

10. The apparatus of claim 1, wherein the heat producing element is located partially within and partially outside of the acoustic enclosure.

11. The apparatus of claim 1, wherein the heat producing element is located outside of the acoustic enclosure.

12. The apparatus of claim 1, further comprising a second surface external to the acoustic enclosure, wherein the heat producing element is thermally coupled to the second surface, and wherein movement of the first diaphragm causes air to flow over the second surface.

13. An apparatus for reproducing acoustic signals, the apparatus comprising:

an acoustic enclosure comprising an acoustic volume;

a heat producing element coupled to the acoustic enclosure;

a thermally conductive structure thermally coupled to the heat producing element, wherein the structure includes a first surface; and a first passive radiator including a first diaphragm, wherein the first diaphragm extends over at least a portion of the first surface and moves in response to pressure variations within the acoustic volume, and wherein movement of the first diaphragm causes air to flow over the first surface; and a second passive radiator that includes a second diaphragm, wherein the second diaphragm extends over at least a portion of a second surface of the structure.

14. The apparatus of claim 13 wherein the structure comprises a fin, and the first and second surfaces are first and second surfaces of the fin.

15. The apparatus of claim 13, wherein the first diaphragm and the second diaphragm move to alternatively expel and intake air over the first and second surfaces.

16. A method of cooling an acoustic enclosure, the method comprising:

positioning a heat producing element comprising an acoustic transducer within the acoustic enclosure;

thermally coupling the acoustic transducer to a thermally conductive structure via a low thermal resistance path that includes a first surface; and positioning a first passive radiator comprising a first diaphragm such that the first diaphragm extends at least partially over the first surface such that movement of the first diaphragm causes air to flow over the first surface.

17. The method of claim 16, further comprising:

positioning a second passive radiator comprising a second diaphragm such that the second diaphragm extends at least partially over a second surface of the thermally structure, such that movement of the second diaphragm causes air to flow over the second surface.

18. The method of claim 17, further comprising securing the thermally conductive structure in a fixed relationship to at least one of the first passive radiator and the second passive radiator using a mounting structure.

* * * * *